United States Patent [19]

Adler

[11] 4,285,106

[45] Aug. 25, 1981

[54] METHOD FOR PRODUCING COLOR CATHODE RAY TUBE APERTURE MASKS

[75] Inventor: Ralph P. I. Adler, Wellesley, Mass.

[73] Assignee: GTE Laboratories Incorporated, Waltham, Mass.

[21] Appl. No.: 103,311

[22] Filed: Dec. 13, 1979

[51] Int. Cl.[3] ..... H01J 29/07

[52] U.S. Cl. ..... 29/25.15

[58] Field of Search ..... 29/25.13, 25.15; 427/290

[56] References Cited

U.S. PATENT DOCUMENTS

| | | | |
|---|---|---|---|
| 3,351,996 | 11/1967 | Fiore | 29/25.15 |
| 3,468,005 | 9/1969 | Kautz | 29/25.13 |
| 3,621,318 | 11/1971 | Lewinson | 313/450 |
| 3,693,223 | 9/1972 | Kaplan | 29/25.13 |
| 3,722,043 | 3/1973 | Kirchner | 29/25.11 |
| 3,765,923 | 10/1973 | Bender-Christensen | 427/290 |

*Primary Examiner*—John McQuade

*Attorney, Agent, or Firm*—Jerry F. Janssen

[57] ABSTRACT

In a process for preparing aperture mask assemblies for color cathode ray tubes, an improvement provides thicker, more adherent protective oxide coatings on the bimetallic mounting members of such assemblies by employing the step of mechanically roughening the surface of the mounting members prior to oxidation.

5 Claims, 2 Drawing Figures

METHOD FOR PRODUCING COLOR CATHODE RAY TUBE APERTURE MASKS

BACKGROUND OF THE INVENTION

This invention relates to methods of fabricating color cathode ray tubes. More particularly, it is concerned with an improved method of fabricating aperture mask assemblies for color cathode ray tubes.

In a color cathode ray tube (CRT), electron beams emanating from the cathodes are directed by means of electromagnetic deflection coils through the holes of an aperture mask onto a pattern of color generating phosphors deposited on the inner glass surface of the tube face panel. In a color television picture tube, for example, the aperture mask may contain upwards of a quarter million holes. Precise registration of the aperture mask holes and the patterned deposit of phosphors must be maintained for proper operation of the tube. This registration becomes particularly critical when thermal strains occur in the mask assembly as the cathode ray tube heats up during operation.

In a typical process of fabricating color CRT aperture mask assemblies, a preformed, apertured mask of thin gauge mild steel is welded to a rigid frame of heavier gauge mild steel. Prior to attaching the mask to the frame, bimetallic mounting members or clips are attached to the periphery of the frame. These bimetallic clips serve the dual functions of providing a means for attaching the mask assembly to the cathode ray tube and of compensating for thermomechanical strains or movement in the aperture mask caused by heating effects during operation of the tube.

During fabrication of a color CRT, the aperture mask assembly is often subjected to humid environments which could cause undesirable rusting of the mild steel. Such rusting is prevented, however, by a step which forms a thin protective coating of black iron oxide on the surfaces of the aperture mask assembly.

A shortcoming of known methods of fabricating aperture mask assemblies occurs in that the step of blackening or oxidizing the mask assembly does not consistently produce an oxide coating that adheres to the bimetallic mounting clips. Because of the differences in oxidation properties of the mask and frame materials from the materials of the bimetallic clips, the conditions for producing a uniform adherent film on the mask and frame are not compatible with the production of an adherent oxide film on the bimetallic clips. In addition, flexing of the bimetallic clips during fabrication or operation of the tube causes flaking of the oxide coating from the clips.

It is therefore the primary object of this invention to provide an improved process for the fabrication of color CRT aperture mask assemblies which produces an adherent film of protective oxide on the bimetallic clips as well as on the mask and frame members of the assemblies.

SUMMARY OF THE INVENTION

In a process for fabricating an aperture mask assembly for a color cathode ray tube comprising the steps of attaching bimetallic mounting members to the periphery of the frame of the mask assembly, attaching a preformed aperture mask to the frame, and forming a protective oxide coating on the bimetallic mounting members, frame, and mask, the improvement of this invention comprises pretreating the surface of the bimetallic mounting members prior to the step of forming the protective oxide coating on the members whereby the oxide coating is adherent to the surface of the members.

In a preferred embodiment of the invention, the surface pretreatment comprises mechanical roughening of the surface of the bimetallic mounting clips by grit blasting.

For a better understanding of the present invention, together with other and further objects, advantages, and capabilities thereof, reference is made to the following disclosure in connection with the above-described drawings.

DETAILED DESCRIPTION

Figure 1:
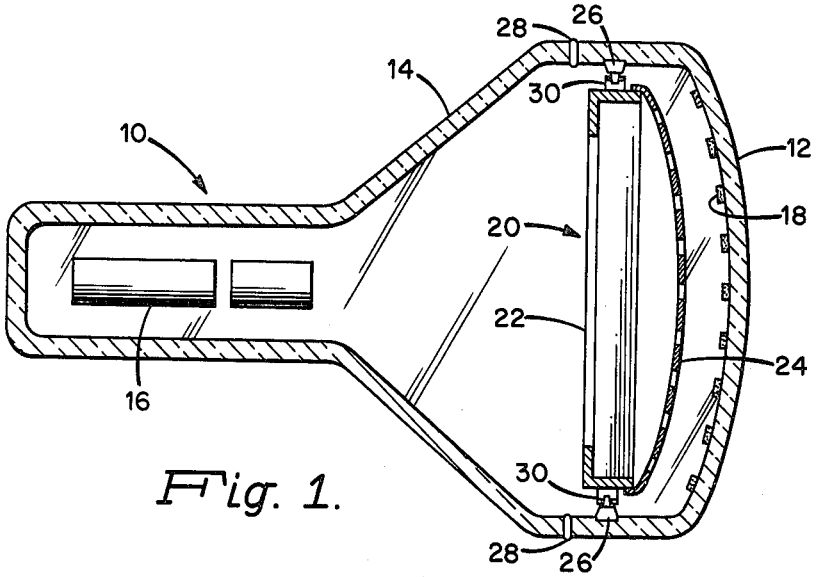
FIG. 1 is a schematic cross-sectional view of a color cathode ray tube.
Figure 2:
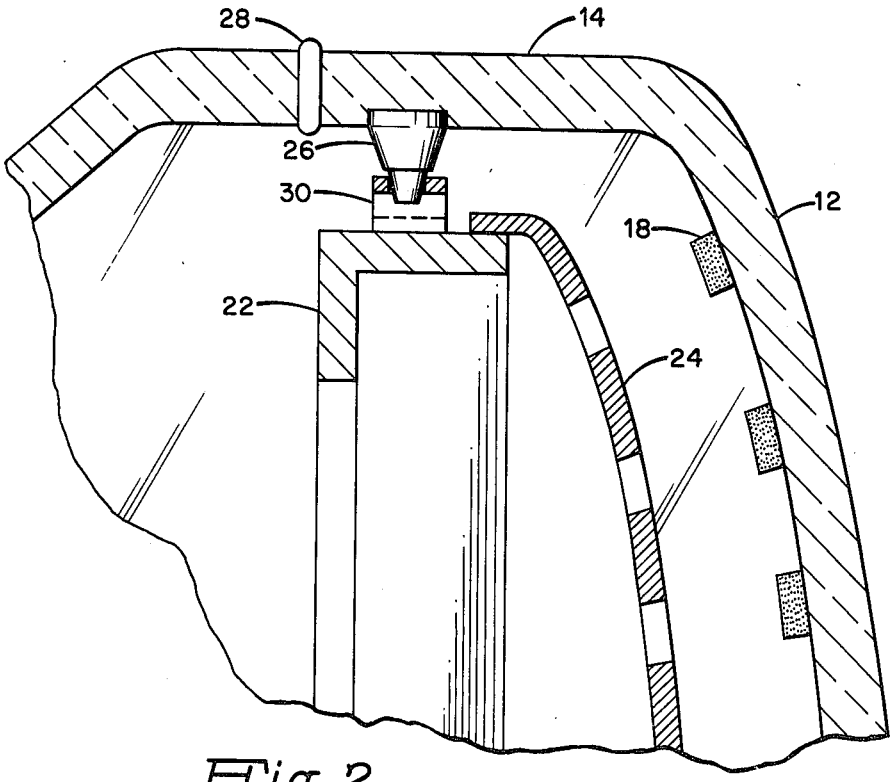
FIG. 2 is a partial enlarged view of the color cathode ray tube of FIG. 1.

Referring to the drawing, there is shown in FIG. 1 in schematic cross-section a typical color CRT 10 comprising a face panel 12 and funnel portion 14 cemented by a ceramic bead 28, an electron gun assembly 16, patterned phosphor deposit 18 on the inner surface of face panel 12, and aperture mask assembly 20. As can be seen in greater detail in FIG. 2, the mask assembly 20 is formed of an aperture mask 24 attached to a rigid frame 22. Bimetallic mounting clips 30 are attached to the periphery of the frame member 22, and serve to mount the mask assembly 20 in the CRT 10 by mating with metal pins 26 embedded in the walls of the tube funnel portion 14.

Typical bimetal mounting clips for color CRT aperture mask assemblies comprise a strip of high expansion alloy steel (for example 22% Ni, 3% Cr, 75% Fe) bonded to a strip of low-expansion alloy such as Invar (40%–50% Ni, balance Fe). When these clips are attached to a mask frame and the combination is "blackened" or oxidized by known techniques, a thin film of oxide forms on both the frame member and the mounting clips. The oxide film which forms on the frame member is thoroughly adherent and functions effectively to protect the frame surface. However, the film of oxide which forms on the bimetallic mounting clips is not consistently adherent when formed by previously known techniques, and sometimes tends to flake or chip away from the bimetal surface when the clip is flexed or bent. Flakes or chips of this non-adherent oxide film may cause undesirable blockage of individual holes in the aperture mask or electrical shorting of elements in the electron gun assembly in a finished color CRT.

It has been found, in accordance with the present invention, that a thicker and firmly adherent protective oxide film may be simultaneously formed on both the mild steel surface of the frame members and upon the surface of the bimetal mounting clips by first pretreating the latter surface. A preferred method of pretreating comprises mechanical roughening of the bimetal surface by grit blasting with a metal oxide grit blasting medium, preferably alumina. By employing grit blasting media of particle size 100 mesh or smaller, a smooth matte finish is produced on the bimetal surface. When this matte surface is oxidized in the same step conventionally employed to oxidize the frame member, a thicker more fully adherent oxide film forms on the bimetal, as illustrated by the data of the Table below.

TABLE

| SAMPLE | MATERIAL | ROCKWELL B HARDNESS | OXIDATIVE WEIGHT GAIN (%) UNTREATED SURFACE | | PRETREATED SURFACE | |
|---|---|---|---|---|---|---|
| 1 | Invar | 99.4 | 0.018 | | 0.046 | |
| 2 | Invar | 94.5 | — | | 0.068 | |
| 3 | Invar | 96.9 | 0.016 | 0.017 (Avg.) | 0.056 | 0.054 (Avg.) |
| 4 | Invar | 96.4 | 0.015 | | 0.056 | |
| 5 | Invar | 98.3 | 0.017 | | 0.045 | |
| 6 | 22/3 Alloy | 106.0 | 0.063 | | 0.076 | |
| 7 | 22/3 Alloy | 107.0 | — | | 0.073 | |
| 8 | 22/3 Alloy | 107.3 | 0.035 | | 0.083 | |
| 9 | 22/3 Alloy | 106.8 | 0.024 | 0.038 (Avg.) | 0.077 | 0.081 (Avg.) |
| 10 | 22/3 Alloy | 109.0 | 0.034 | | 0.080 | |
| 11 | 22/3 Alloy | 106.4 | 0.038 | | 0.090 | |
| 12 | 22/3 Alloy | 107.1 | 0.035 | | 0.085 | |

Sample coupons 1 inch×¼ inch×0.035 inches thick were cut from both the high expansion (22/3 alloy steel) and the low expansion (Invar) strip materials used for the fabrication of typical bimetalic mounting clips. Slight variation in the Rockwell B hardness of the samples indicated slight variation in the bulk properties of the samples taken from different lots of bimetal stock.

Coupons of each sample were subjected to blackening or oxidation both with and without surface pretreatment in accordance with this invention. The samples were oxidized by heating to 650° F. (343° C.) for 10 minutes, followed by heating to 1060° F. (571° C.) for 25½ minutes in the presence of steam, with an overall cycle time of 75 minutes. Surface pretreated samples were pretreated in accordance with this invention by grit blasting on a Trinco Dry Blast Unit, Model D18 (Trinco Incorporated, 25140 Easy Street, Warren, MI 48089) using nominal 100 mesh alumina grit media. Following the steps of grit blasting, but prior to oxidative blackening, the Invar coupons were found to have lost about 0.7% of their weight, and the 22/3 alloy steel coupons about 0.1%.

As can be seen by the data of the Table, a much thicker oxide coating formed on both the Invar sample coupons and the 22/3 alloy steel coupons after surface pretreatment than when oxidized without such pretreatment. The thicker oxide coatings obtained by surface mechanical roughening prior to oxidation, in accordance with this invention, are believed to be due to the synergistic effect of cold working of the metal surface by the inertial impact of the grit particles and microscopic roughening by the erosive effects of the grit blasting.

Adherence of the oxide coatings was tested for each sample by plastic deformation of each coupon to have a bend of about 5°, after which a piece of adhesive tape was applied to and then removed from the surface of the coupon on the concave side of the bend. The amount and character of any oxide coating stripped away by the tape was then noted. It was found that for every sample of Invar, the oxide coating on coupons which had not been pretreated delaminated and showed some tendency toward flaking. In those cases of samples of the 22/3 steel alloy which had not been pretreated, delamination of the oxide coating also occurred with considerable flaking. However, in the cases of samples of both Invar and 22/3 alloy coupons which had been surface pretreated in accordance with this invention, no delamination of the oxide coatings was observed. This result was surprising in view of the heavier character of the oxide coatings of the surface pretreated coupons compared with those of the unpretreated coupons. This result illustrates the differences in microstructure and surface bonding characteristics of oxide coatings of the pretreated and unpretreated samples.

The step of pretreating the surface of bimetallic mounting clips of color CRT aperture mask assemblies prior to forming a protective oxide coating on the mask assembly members is thus seen as an improved method over known prior art methods.

While there has been shown and described what is at present considered the preferred embodiments of the invention, it will be obvious to those skilled in the art that various changes and modifications may be made therein without departing from the scope of the invention as defined by the appended claims.

What is claimed is:

1. In a process for fabricating an aperture mask assembly for a color cathode ray tube including the steps of:

(a) attaching bimetallic mounting members to the periphery of the metal frame of said aperture mask assembly;

(b) attaching a pre-formed aperture mask to said metal frame; and (c) forming a protective oxide coating on said bimetallic mounting members, frame, and mask;

the improvement comprising the step of mechanically roughening the surface of said bimetallic mounting members prior to the step of forming said protective oxide coating therein whereby said oxide coating is adherent to said surface.

2. A process in accordance with claim 1 wherein said mechanical roughening comprises grit blasting said surface of said bimetallic mounting members.

3. A process in accordance with claim 2 wherein said grit blasting employs a metal oxide grit blasting medium.

4. A process in accordance with claim 3 wherein said grit blasting medium is of nominal particle size up to 100 mesh.

5. A process in accordance with claim 3 wherein said metal oxide grit blasting medium includes alumina.

* * * * *